United States Patent [19]

Flentge

[11] Patent Number: 5,014,578

[45] Date of Patent: May 14, 1991

[54] PIPE TONGS

[76] Inventor: Melvin L. Flentge, 941 FM 2502, Bellville, Tex. 77418

[21] Appl. No.: 462,047

[22] Filed: Jan. 8, 1990

[51] Int. Cl.[5] ..... B25B 7/12

[52] U.S. Cl. ..... 81/367; 81/323; 81/420; 81/423; 81/424.5

[58] Field of Search ..... 81/322, 323, 331, 367, 81/418, 420, 423, 424.5, 180.1, 57.35, 487; 294/90, 902

[56] References Cited

U.S. PATENT DOCUMENTS

| | | | |
|---|---|---|---|
| 1,086,078 | 2/1914 | Palmer | 81/331 X |
| 3,808,870 | 5/1974 | Blancett | 81/423 X |
| 3,981,209 | 9/1976 | Caroff | 81/367 |
| 4,104,936 | 8/1978 | Sjöström | 81/180.1 |
| 4,318,316 | 3/1982 | Guilliams | 81/367 X |

*Primary Examiner*—James G. Smith
*Attorney, Agent, or Firm*—Neal J. Mosely

[57] ABSTRACT

A pipe clamping device, viz., pipe tongs, is shown which is particularly adapted to securing pipe as it is lowered into a pipe casing in the earth. The pipe tongs consist of a fixed handle with a removable pipe clamp at one end thereof and an adjustment screw at the other end, and a movable jaw member with a removable pipe clamp at one end thereof, a movable handle connected to the movable jaw member at one end and having a latch with an operating lever at the other end. A linkage is connected between the movable handle and the adjustment screw to provide an adjustable toggle or locking mechanism for the handles and movable jaw member of the tongs. A catch on the fixed handle is engaged by the latch to secure the movable handle in a locked, closed position. The removable pipe clamps are provided in a variety of sizes and shaped for accommodating different pipes. The pipe tong handles have projections beyond the point of support for the pipe clamps which provide means to support the tongs on a well casing and to support a wire or cable spaced from the wall of the well casing while lowering pipe into the casing.

23 Claims, 2 Drawing Sheets

PIPE TONGS

FIELD OF THE INVENTION

This invention relates generally to a pipe clamping device, viz., pipe tongs particularly adapted to securing pipe as it is lowered into a pipe casing in the earth.

BACKGROUND OF THE INVENTION

Toggle-operated, locking pliers have been available commercially for many years. Some toggle-operated, locking pliers are of a size for use in plumbing for connecting and disconnecting pipes and pipe fittings. Other toggle-operated, locking pliers have been designed for special purposes with specially designed clamps or jaws.

Belval U.S. Pat. No. 3,290,971 discloses a toggle-operated, locking pipefitters tool with specially designed clamps or jaws with spaced rods for handling different sized pipes and pipe fittings.

Lock U.S. Pat. No. 3,578,307 discloses a toggle-operated, pipe wrench.

Nunez U.S. Pat. No. 3,718,327 discloses a C-clamp with toggle-operated, locking tools secured thereon for positioning and supporting a workpiece.

Fideldy U.S. Pat. No. 3,884,100 discloses a pipe tongs with toggle-operated, locking action and having specially designed "C" jaws for handling pipes of selected sizes.

Guilliams U.S. Pat. No. 4,318,316 discloses toggle-operated, locking pliers with specially designed clamps or jaws for handling threaded hanger rods without damaging threads.

Dearman U.S. Pat. No. 4,344,215 discloses a toggle-operated, locking pipefitters tool with specially designed "V" clamps or jaws for handling different sized pipes and pipe fittings.

Costello U.S. Pat. No. 4,477,937 discloses a combined wrench, locking pliers and chain wrench using a toggle for the gripping and clamping functions.

This invention is an improvement over the prior art pliers and tongs in that it consists of a fixed handle with a removable pipe clamp at one end thereof and an adjustment screw at the other end, and a movable jaw member with a removable pipe clamp at one end thereof, a movable handle connected to the movable jaw member at one end and having a latch with an operating lever at the other end. A linkage is connected between the movable handle and the adjustment screw to provide an adjustable toggle or locking mechanism for the handles and movable jaw member of the tongs; a latch on the fixed handle is engaged by a catch to secure the movable handle in a locked, closed position; the removable pipe clamps are provided in a variety of sizes and shaped for accommodating different pipes; and the pipe tong handles have projections beyond the point of support for the pipe clamps which provide a means to support the tongs on a well casing and to support a wire or cable spaced from the wall of the well casing while lowering pipe into the casing.

SUMMARY OF THE INVENTION

It is therefore a general object of this invention to provide a new and improved pipe tongs for lowering pipe into a well casing.

It is another object of the present invention to provide a new and improved locking pipe tongs for lowering pipe into a well casing.

It is another object of this invention to provide a new and improved locking pipe tongs with a toggle mechanism, for lowering pipe into a well casing.

It is another object of this invention to provide a new and improved pipe tongs for lowering pipe into a well casing constructed to provide for supporting the tongs and pipe on the upper end of the well casing.

It is another object of this invention to provide a new and improved pipe tongs for lowering pipe into a well casing having means for supporting wire spaced from the well casing while lowering the pipe.

It is another object of this invention to provide a new and improved locking pipe tongs with a toggle mechanism, for lowering pipe into a well casing and constructed to provide for supporting the tongs and pipe on the upper end of the well casing.

It is another object of this invention to provide a new and improved pipe tongs for lowering pipe into a well casing having means for supporting wire spaced from the well casing while lowering the pipe and constructed to provide for supporting the tongs and pipe on the upper end of the well casing.

Other objects of the invention will become apparent from time to time throughout the specification and claims as hereinafter related.

The above noted and other objects of the invention are accomplished by a pipe clamping device, viz., pipe tongs, which is particularly adapted to securing pipe as it is lowered into a pipe casing in the earth. The pipe tongs consist of a fixed handle with a removable pipe clamp at one end thereof and an adjustment screw at the other end, and a movable jaw member with a removable pipe clamp at one end thereof, a movable handle connected to the movable jaw member at one end and having a latch with an operating lever at the other end. A linkage is connected between the movable handle and the adjustment screw to provide an adjustable toggle or locking mechanism for the handles and movable jaw member of the tongs. A catch on the fixed handle is engaged by the latch to secure the movable gandle in a locked, closed position. The removable pipe clamps are provided in a variety of sizes and shaped for accommodating different pipes. The pipe tong handles have projections beyond the point of support for the pipe clamps which provide means to support the tongs on a well casing and to support a wire or cable spaced from the wall of the well casing while lowering pipe into the casing.

DESCRIPTION OF THE PREFERRED EMBODIMENT

Figure 2:
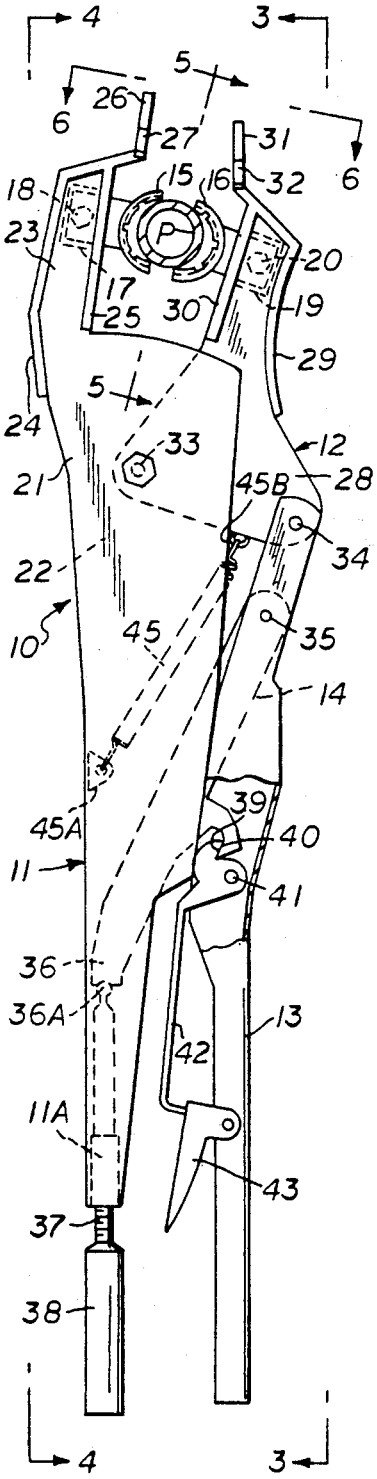
FIG. 2 is a plan view of novel pipe tongs illustrating a preferred embodiment of this invention in a closed, clamping position.
Figure 1:
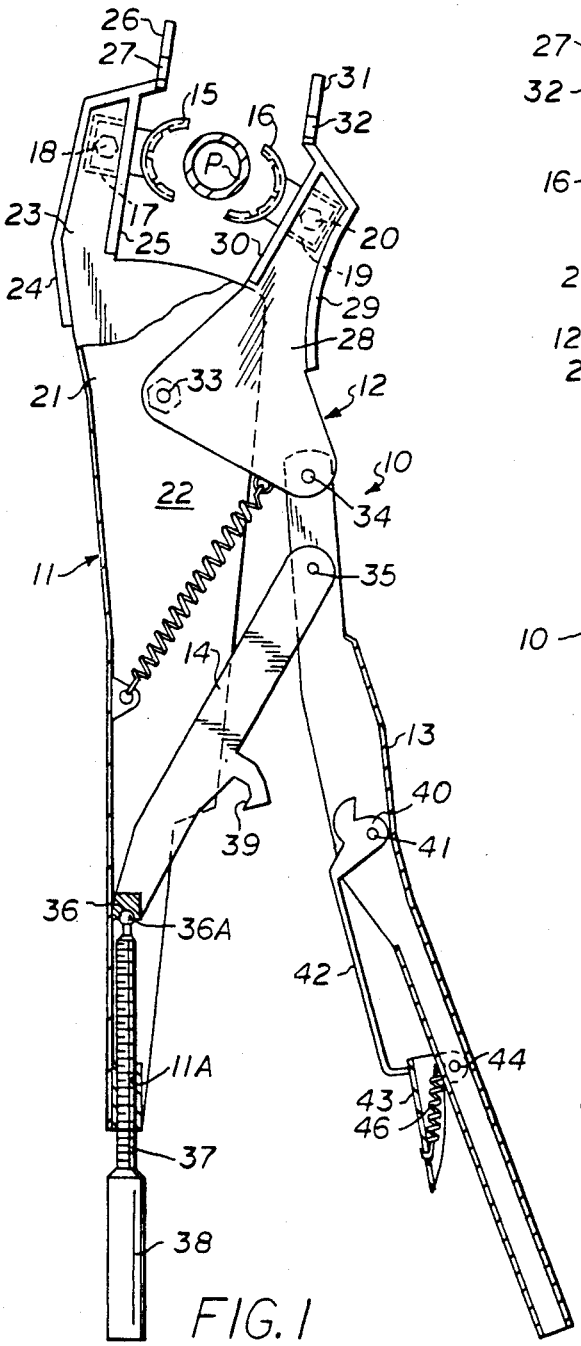
FIG. 1 is a plan view of novel pipe tongs illustrating a preferred embodiment of this invention in an open position.
Figure 3:
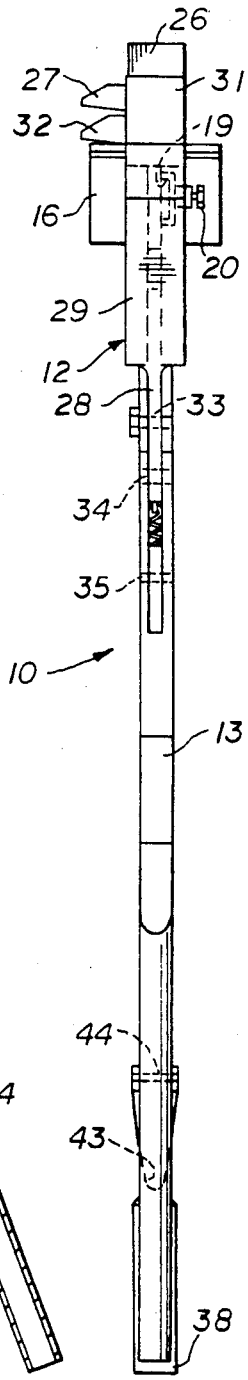
FIG. 3 is a right edge elevation of the pipe tongs taken along line 3—3 of FIG. 2 showing the movable jaw and handle portions
Figure 4:
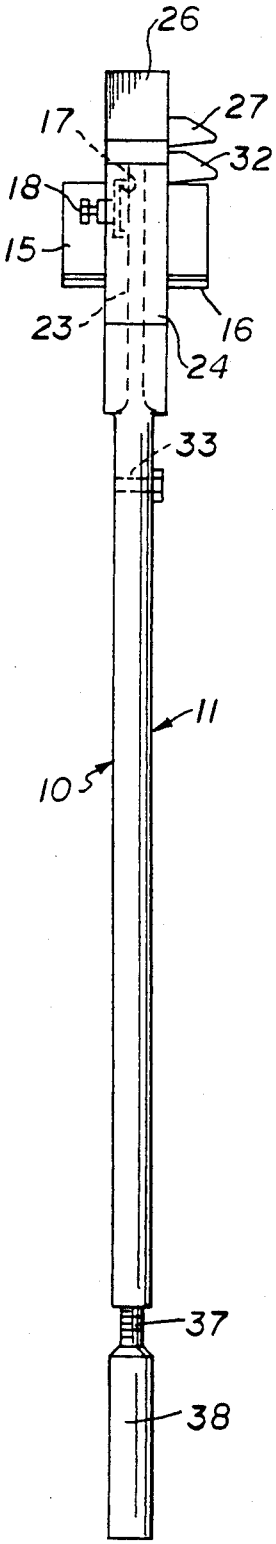
FIG. 4 is a left edge elevation of the pipe tongs taken along line 4—4 of FIG. 2 showing the fixed jaw and handle portions.
Figure 5:
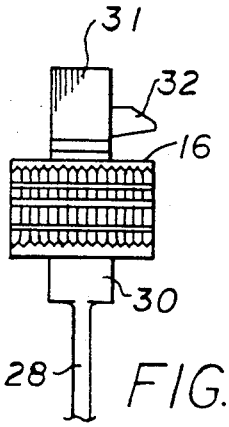
FIG. 5 is a left edge elevation of the movable jaw of the pipe tongs taken along line 5—5 of FIG. 2.
Figure 6:
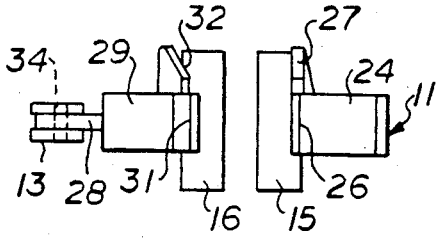
FIG. 6 is a top end elevation of the pipe tongs taken along line 6—6 of FIG. 2.
Figure 7:
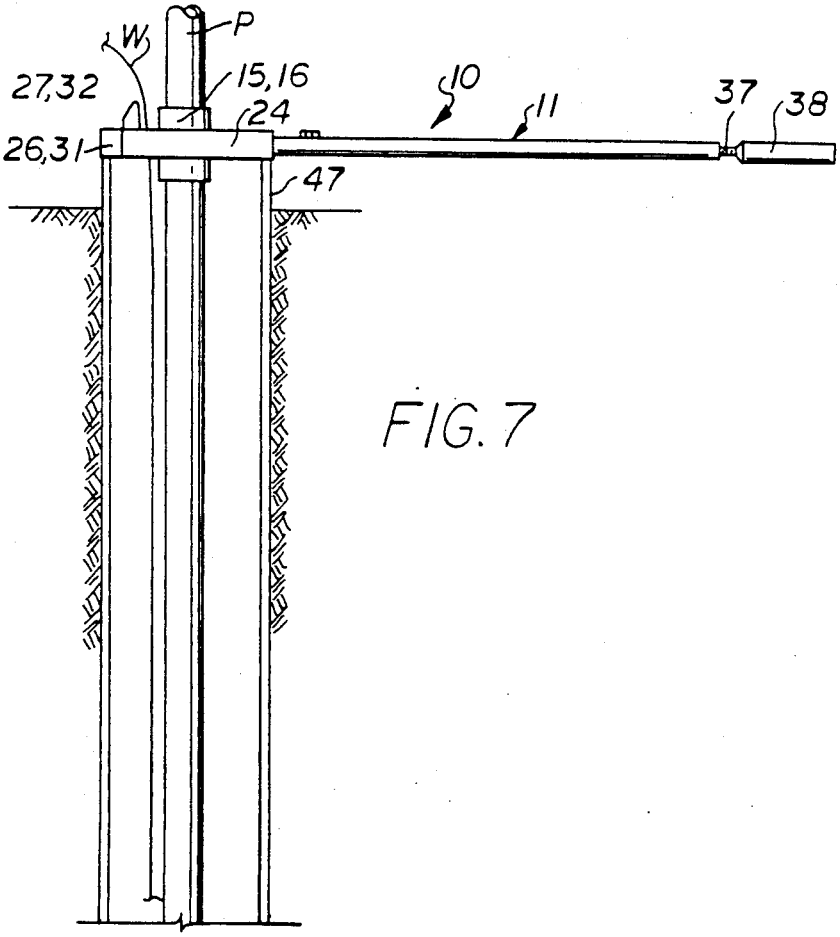
FIG. 7 is a sectional view of the earth showing a well casing in place and the pipe tongs illustrated in FIGS. 1 and 2 positioned on the top of the casing supporting a pipe being lowered into the well.

Referring to the drawings by numerals of reference, and more particularly to FIGS. 1 and 2, there is shown a pair of pipe tongs 10 of a toggle locking type. Pipe tongs 10 comprise fixed handle 11, movable jaw member 12, movable handle 13 and toggle linkage 14. The upper end of fixed handle 11 supports a removable pipe clamp 15. Movable jaw member 12 supports a removable pipe clamp 16 cooperable with fixed handle pipe clamp 15. Fixed handle pipe clamp 15 is positioned in a slot 17 in the upper end of fixed handle 11 and secured by a lock screw 18. Movable jaw member pipe clamp 16 is positioned in a slot 19 in the upper end of movable jaw member 16 and secured by lock screw 20. Pipe clamps 15 and 16 are replaceable and provided in different sizes and shapes to handle different sizes and shapes of pipes.

Fixed handle 11 has a channel body member portion 21 with a slot 22 in which movable jaw member 12 is positioned and secured for pivotal movement. The upper or outer end of fixed handle 11 has a clamp supporting portion 23 with edge flanges 24 and 25 and a outwardly extending flange portion 26 with a laterally extending pointed tang 27.

Movable jaw member 12 has a flat plate portion 28 secured in slot 22 for pivotal movement. Movable jaw member 12 has a flat plate portion 28 with edge flanges 29 and 30 and an outwardly extending flange portion 31 with a laterally extending pointed tang 32. Flat plate portion 28 is supported for pivotal movement in slot 22 by a pivot pin 33.

An outer portion of flat plate portion 28 is connected by pivot pin 34 to an upper end of movable handle 13. Toggle linkage 14 has an upper end portion connected by pivot pin 35 to an intermediate portion of movable handle 13 and a lower end portion with a socket 36 which receives a ball 36*a* on the upper end of adjustment screw 37. The lower end of adjustment screw 37 has a handle or knob 38 for turning to adjust the position of ball 36*a* and the lower end of toggle linkage 14. The lower end of fixed handle 11 has an internally threaded portion 11*a* which threadedly receives the adjustment screw 37. The adjustment screw 37 moves axially upon rotation of the screw handle 38.

Toggle linkage 14 has a fixed catch 39 thereon which cooperates with pivoted latch 40 on movable handle 13. Pivoted latch 40 is supported in a channel slot in movable handle 13 on pivot pin 41 and is connected by wire hook 42 to the upper end of a release handle 43 which is supported in the channel slot in movable handle 13 on pivot pin 44. Spring 45 is secured at opposite ends to ears 45*a* and 45*b* on fixed handle 11 and movable jaw member 12 respectively and urges movable jaw member 12 toward an open position. Spring 46 is secured at opposite ends to release handle 43 and a wall of movable handle 13 and urges pivoted latch 40 and movable handle 13 in a clockwise direction toward a latching position.

OPERATION

The operation of these pipe tongs should be obvious but will be restated in detail to set forth the advantages of the invention. In FIG. 2, the pipe tongs 10 are shown in an open position. Movable handle 13 is moved away from fixed handle 11 to move toggle linkage 14 away from its straightened position and to allow movable jaw member pipe clamp 16 to move away from fixed handle pipe clamp 15. Pivoted latch 40 is out of engagement with fixed catch 39 but is urged by spring 46 toward the latch engaging position. The pipe tongs 10 are similar in some respects to "vise-grip" pliers but are of a much larger size, e.g., about 3'–4' long.

The pipe tongs 10 are placed around a pipe P which is to be inserted into a well casing 47 in the earth E. Movable handle 13 is squeezed to move it toward fixed handle 11 while pressing release handle 43. As movable jaw member pipe clamp 16 is moved toward fixed handle pipe clamp 15, by toggle movement of movable jaw member 12, the jaw members engage and clamp pipe P. This movement straightens the toggle mechanism and moves pivoted latch 40 into engagement with fixed catch 39 at which point release of release handle 43 engages the catch to lock the pipe tongs on Pipe P.

When the pipe tongs 10 are locked on pipe P, the pipe is inserted into well casing 47 until it is supported by the tongs engaging the top edge of the casing 47. The tongs can be released as desired for lowering pipe P into the well casing 47 and to facilitate making pipe joints as additional pipe is added to the pipe string. The outwardly extending flange portion 26 and outwardly extending flange portion 31 on fixed handle 11 and movable jaw member 12, respectively, provide the required support when laid across the upper edge of well casing 47. When the pipe tongs 10 are in use, the wire W is threaded over or around the upwardly extending tangs 27 and 32 to support the wire out of engagement with the pipe and with the wall of the well casing as the pipe and wire are lowered into the well casing.

While this invention has been described fully and completely, with special emphasis on a single preferred embodiment, it should be understood that, within the scope of the appended claims, the invention may be practiced otherwise than as specifically set forth above.

I claim:

1. A pipe clamping device comprising a fixed handle, a removable pipe clamp at one end of and projecting laterally from said fixed handle an adjustment screw at another end of said fixed handle, a movable jaw member, a removable pipe clamp at one end of and projecting laterally from said movable jaw member, a movable handle pivotally connected at one end to said movable jaw member, a movable latch and an operating lever therefor at another end of said movable handle, a linkage connected between said movable handle and said adjustment screw to provide an adjustable toggle, locking mechanism for said handles and movable jaw member of said tongs, a catch on said fixed handle engaged by said latch to secure said movable handle and movable jaw member in a locked, closed position, and a pair of projections one on each of the outer ends of said fixed handle and said movable jaw member beyond said pipe clamps providing means to support said tongs on a well casing and to support a wire or cable spaced from the wall of a well casing while lowering pipe thereinto.

2. A pipe clamping device according to claim 1 in which said projections beyond the point of support for the pipe clamps provide means to support the tongs on a well casing and include laterally extending tangs to support a wire or cable spaced from the wall of the well casing while lowering pipe into the casing.

3. A pipe clamping device according to claim 1 in which said pipe clamps are each replaceable and provided in different sizes and shapes to handle different sizes and shapes of pipes.

4. A pipe clamping device according to claim 1 in which said projections beyond the point of support for the pipe clamps provide means to support the tongs on a well casing and include laterally extending tangs to support a wire or cable spaced from the wall of the well casing, and said pipe clamps are each replaceable and provided in different sizes and shapes to handle different sizes and shapes of pipes.

5. A pipe clamping device according to claim 1 in which said one end of said fixed handle and said movable jaw member each have laterally extending edge slots therein and locking screws for each said slot, and each of said removable pipe clamps having a support inserted one in each of said slots and secured in place by said locking screws.

6. A pipe clamping device according to claim 1 in which said pipe clamps are each replaceable and provided in different sizes and shapes to handle different sizes and shapes of pipes, said one end of said fixed handle and said movable jaw member each have laterally extending edge slots therein and locking screws for each said slot, and each of said removable pipe clamps having a support inserted one in each of said slots and secured in place by said locking screws.

7. A pipe clamping device according to claim 1 in which said projections beyond the point of support for the pipe clamps provide means to support the tongs on a well casing and include laterally extending tangs to support a wire or cable spaced from the wall of the well casing, said pipe clamps are each replaceable and provided in different sizes and shapes to handle different sizes and shapes of pipes, said one end of said fixed handle and said movable jaw member each have laterally extending edge slots therein and locking screws for each said slot, and each of said removable pipe clamps having a support inserted one in each of said slots and secured in place by said locking screws.

8. A pipe clamping device according to claim 1 in which said movable jaw member is spring loaded toward an open position and movable toward a closed position by action of said movable handle and said toggle linkage.

9. A pipe clamping device according to claim 1 in which said movable latch member and operating lever are spring loaded toward a closed position and movable toward open position by operation of said operating lever.

10. A pipe clamping device according to claim 1 in which said movable jaw member is spring loaded toward an open position and movable toward a closed position by action of said movable handle and said toggle linkage, and said movable latch member and operating lever are spring loaded toward a closed position and movable toward open position by operation of said operating lever.

11. A pipe clamping device according to claim 1 in which said movable jaw member is spring loaded toward an open position and movable toward a closed position by action of said movable handle and said toggle linkage, and said projections beyond the point of support for the pipe clamps provide means to support the tongs on a well casing and include laterally extending tangs to support a wire or cable spaced from the wall of the well casing while lowering pipe into the casing.

12. A pipe clamping device according to claim I in which said movable jaw member is spring loaded toward an open position and movable toward a closed position by action of said movable handle and said toggle linkage, and said pipe clamps are each replaceable and provided in different sizes and shapes to handle different sizes and shapes of pipes.

13. A pipe clamping device according to claim 1 in which said movable jaw member is spring loaded toward an open position and movable toward a closed position by action of said movable handle and said toggle linkage, and said projections beyond the point of support for the pipe clamps provide means to support the tongs on a well casing and include laterally extending tangs to support a wire or cable spaced from the wall of the well casing, and said pipe clamps are each replaceable and provided in different sizes and shapes to handle different sizes and shapes of pipes.

14. A pipe clamping device according to claim 1 in which said movable jaw member is spring loaded toward an open position and movable toward a closed position by action of said movable handle and said toggle linkage, said one end of said fixed handle and said movable jaw member each have laterally extending edge slots therein and locking screws for each said slot, and each of said removable pipe clamps having a support inserted one in each of said slots and secured in place by said locking screws.

15. A pipe clamping device according to claim 1 in which said movable jaw member is spring loaded toward an open position and movable toward a closed position by action of said movable handle and said toggle linkage, and said pipe clamps are each replaceable and provided in different sizes and shapes to handle different sizes and shapes of pipes, said one end of said fixed handle and said movable jaw member each have laterally extending edge slots therein and locking screws for each said slot, and each of said removable pipe clamps having a support inserted one in each of said slots and secured in place by said locking screws.

16. A pipe clamping device according to claim 1 in which said movable jaw member is spring loaded toward an open position and movable toward a closed position by action of said movable handle and said toggle linkage, said projections beyond the point of support for the pipe clamps provide means to support the tongs on a well casing and include laterally extending tangs to support a wire or cable spaced from the wall of the well casing, said pipe clamps are each replaceable and provided in different sizes and shapes to handle different sizes and shapes of pipes, said one end of said fixed handle and said movable jaw member each have laterally extending edge slots therein and locking screws for each said slot, and each of said removable pipe clamps having a support inserted one in each of said slots and secured in place by said locking screws.

17. A pipe clamping device according to claim 1 in which said movable latch member and operating lever are spring loaded toward a closed position and movable toward open position by operation of said operating lever, said movable jaw member is spring loaded toward an open position and movable toward a closed position by action of said movable handle and said toggle linkage, and said projections beyond the point of support for the pipe clamps provide means to support the tongs on a well casing and include laterally extending tangs to support a wire or cable spaced from the wall of the well casing while lowering pipe into the casing.

18. A pipe clamping device according to claim 1 in which said movable latch member and operating lever are spring loaded toward a closed position and movable toward open position by operation of said operating lever, said movable jaw member is spring loaded toward an open position and movable toward a closed position by action of said movable handle and said toggle linkage, and said pipe clamps are each replaceable and provided in different sizes and shapes to handle different sizes and shapes of pipes.

19. A pipe clamping device according to claim 1 in which said movable latch member and operating lever are spring loaded toward a closed position and movable toward open position by operation of said operating lever, said movable jaw member is spring loaded toward an open position and movable toward a closed position by action of said movable handle and said toggle linkage, and said projections beyond the point of support for the pipe clamps provide means to support the tongs on a well casing and include laterally extending tangs to support a wire or cable spaced from the wall of the well casing, and said pipe clamps are each replaceable and provided in different sizes and shapes to handle different sizes and shapes of pipes.

20. A pipe clamping device according to claim 1 in which said movable latch member and operating lever are spring loaded toward a closed position and movable toward open position by operation of said operating lever, said movable jaw member is spring loaded toward an open position and movable toward a closed position by action of said movable handle and said toggle linkage, said one end of said fixed handle and said movable jaw member each have laterally extending edge slots therein and locking screws for each said slot, and each of said removable pipe clamps having a support inserted one in each of said slots and secured in place by said locking screws.

21. A pipe clamping device according to claim 1 in which said movable latch member and operating lever are spring loaded toward a closed position and movable toward open position by operation of said operating lever, said movable jaw member is spring loaded toward an open position and movable toward a closed position by action of said movable handle and said toggle linkage, and said pipe clamps are each replaceable and provided in different sizes and shapes to handle different sizes and shapes of pipes, said one end of said fixed handle and said movable jaw member each have laterally extending edge slots therein and locking screws for each said slot, and each of said removable pipe clamps having a support inserted one in each of said slots and secured in place by said locking screws.

22. A pipe clamping device according to claim 1 in which said movable latch member and operating lever are spring loaded toward a closed position and movable toward open position by operation of said operating lever, said movable jaw member is spring loaded toward an open position and movable toward a closed position by action of said movable handle and said toggle linkage, said projections beyond the point of support for the pipe clamps provide means to support the tongs on a well casing and include laterally extending tangs to support a wire or cable spaced from the wall of the well casing, said pipe clamps are each replaceable and provided in different sizes and shapes to handle different sizes and shapes of pipes, said one end of said fixed handle and said movable jaw member each have laterally extending edge slots therein and locking screws for each said slot, and each of said removable pipe clamps having a support inserted one in each of said slots and secured in place by said locking screws.

23. A pipe clamping device of a toggle locking type comprising a fixed handle, a movable jaw member, movable handle, a toggle linkage operatively connected between said a movable jaw member and said movable handle, a removable pipe clamp supported in an upper end of said fixed handle, a removable pipe clamp supported in said movable jaw member and cooperable with said fixed handle pipe clamp, said fixed handle having a slot in said upper end removably receiving said first named removable pipe clamp and a locking screw securing the same in place, said movable jaw member having a slot in said upper end removably receiving said second named removable pipe clamp and a locking screw securing the same in place, said jaw members being replaceable and provided in a number of different sizes and shapes to handle different sizes and shapes of pipes, said fixed handle having a channel body member portion with a slot in which movable jaw member is positioned and secured for pivotal movement, an upper, outer end of said fixed handle having a pipe clamp supporting portion with edge flanges and a outwardly extending flange portion with a laterally extending pointed tang, said movable jaw member having a flat plate portion secured in said fixed handle slot for pivotal movement by a pivot pin, said movable jaw member flat plate portion having edge flanges and an outwardly extending flange portion with a laterally extending pointed tang, a pivot pin connecting an outer portion of said movable jaw member flat plate portion to an upper end of movable handle, a pivot pin connecting an upper end portion of said toggle linkage to an intermediate portion of said movable handle, said fixed handle having a tubular, threaded handle portion and an adjustment screw therein with a ball at an upper end thereof, said toggle linkage having a lower end portion with a socket receiving said a ball on the upper end of said adjustment screw, a lower end of said adjustment screw having a handle or knob for turning to adjust the position of said ball and the lower end of said toggle linkage, a fixed catch on said toggle linkage and a pivoted latch on said movable handle, a channel slot and pivot pin in said movable handle in which said pivoted latch is supported for pivotal movement on said pivot pin, a release handle pivotally supported on said movable handle, a wire hook connecting said pivoted latch to the upper end of said release handle, a spring secured at opposite ends to said fixed handle and said movable jaw member respectively and urging said movable jaw member toward an open position, and a spring secured at opposite ends to said release handle and said movable handle and urging said pivoted latch and said movable handle in a clockwise direction toward a latching position.

* * * * *